US008251027B2

(12) United States Patent
Lee et al.

(10) Patent No.: US 8,251,027 B2
(45) Date of Patent: Aug. 28, 2012

(54) CONTINUOUS VARIABLE VALVE LIFT APPARATUS

(75) Inventors: Eun Ho Lee, Hwaseong (KR); Young Hong Kwak, Suwon (KR); Ki Young Kwon, Seoul (KR); Jin Kook Kong, Suwon (KR); Soo Hyung Woo, Yongin (KR); Young Nam Kim, Seongnam (KR)

(73) Assignee: Hyundai Motor Company, Seoul (KR)

( * ) Notice: Subject to any disclaimer, the term of this patent is extended or adjusted under 35 U.S.C. 154(b) by 462 days.

(21) Appl. No.: 12/533,544

(22) Filed: Jul. 31, 2009

(65) Prior Publication Data

US 2010/0122677 A1 May 20, 2010

(30) Foreign Application Priority Data

Nov. 20, 2008 (KR) ..... 10-2008-0115627

(51) Int. Cl.
*F01L 1/34* (2006.01)

(52) U.S. Cl. ..... 123/90.16

(58) Field of Classification Search ..... 123/90.16, 123/90.15

See application file for complete search history.

(56) References Cited

U.S. PATENT DOCUMENTS

| | | | | |
|---|---|---|---|---|
| 6,390,041 | B2 * | 5/2002 | Nakamura et al. | 123/90.15 |
| 6,439,177 | B2 | 8/2002 | Pierik | |
| 6,595,172 | B2 * | 7/2003 | Kabasin et al. | 123/90.16 |
| 7,111,600 | B2 | 9/2006 | Naumann | |
| 7,188,595 | B2 | 3/2007 | Hara | |
| 7,246,578 | B2 * | 7/2007 | Nakamura et al. | 123/90.16 |
| 7,451,729 | B2 | 11/2008 | Sugiura et al. | |
| 7,814,873 | B2 * | 10/2010 | Tateno et al. | 123/90.16 |
| 7,823,552 | B2 * | 11/2010 | Kwon et al. | 123/90.16 |

FOREIGN PATENT DOCUMENTS

JP 2006-70735 A 3/2006

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve lift apparatus may include an input unit, a control link disposed to a control shaft, a driving cam that is provided with a contact portion and pivotally disposed to the control shaft, a valve opening unit that contacts the contact portion and is opened and closed in accordance with pivoting of the driving cam, wherein the control link, the input unit and the driving cam are connected by a connecting unit, and contact positions of the valve opening unit and the contact portion are variable according to a relative rotation angle of the control link around the control shaft.

7 Claims, 4 Drawing Sheets

CONTINUOUS VARIABLE VALVE LIFT APPARATUS

CROSS-REFERENCE TO RELATED APPLICATION

The present application claims priority to Korean Patent Application No. 10-2008-0115627 filed on Nov. 20, 2008, the entire contents of which are incorporated herein for all purposes by this reference.

BACKGROUND OF THE INVENTION

1. Field of the Invention

The present invention relates to a continuous variable valve lift apparatus. More particularly, the present invention relates to a continuous variable valve lift apparatus that can adjust a valve lift amount in response to an operational state of an engine.

2. Description of Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables variable valve lifts depending on the engine speed. For such a VVL apparatus, it is recommended that power loss in driving the valves using torque of the camshaft is minimized. In addition, it is recommended that the VVL apparatus is symmetrically designed such that it may be symmetrically installed in both banks in a V-engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuous variable valve lift (CVVL) apparatus having various advantages such as minimized friction and power loss without springs, rollers and so on and enhanced controllability and ease of assembly.

In an aspect of the present invention, the continuous variable valve lift apparatus may include an input unit, a control link fastened to a control shaft, a driving cam including a contact portion and pivotally coupled to the control shaft, a valve opening unit that contacts the contact portion and is opened and closed in accordance with pivoting of the driving cam, wherein the control link, the input unit and the driving cam are connected by a connecting unit, and wherein contact positions of the valve opening unit with the contact portion are variable according to a relative rotation angle of the control link around the control shaft.

The input unit may include a cam shaft, and an input cam eccentrically disposed to the camshaft, wherein the connecting unit includes, a first connecting link connecting the input cam and the control link, and a second connecting link connecting the input cam and the driving cam.

The contact portion may include a zero lift portion wherein a contour thereof is constant from a center of the control shaft, and a lift portion wherein a contour thereof is gradually thicker away from the center of the control shaft.

In another aspect of the present invention, the continuous variable valve lift apparatus may include a camshaft, an input cam eccentrically coupled to the camshaft, a control shaft parallel with the camshaft, a driving cam pivotally coupled to the control shaft, and a valve opening unit that is opened and closed in accordance with pivoting of the driving cam, wherein a valve lift is variable according to a relative pivoting angle of the driving cam around the control shaft.

The continuous variable valve lift apparatus may further include a control link fastened to the control shaft, and a connecting unit connecting the control link, the input cam and the driving cam, wherein the connecting unit includes, a first connecting link connecting the input cam and the control link, and a second connecting link connecting the input cam and the driving cam.

The continuous variable valve lift apparatus may further include a contact portion formed to the driving cam, wherein the valve opening unit contacts the contact portion, wherein the contact portion includes, a zero lift portion wherein a contour thereof is constant from a center of the control shaft, and a lift portion wherein a contour thereof is gradually thicker away from the center of the control shaft.

In further another aspect of the present invention, the continuous variable valve lift apparatus may include a camshaft, an input cam eccentrically coupled to the camshaft, a control shaft coupled to an actuator to control a rotation angle of the control shaft, a control link fastened to the control shaft, a driving cam pivotally coupled to the control shaft and including a contact portion, a first connecting link connecting the input cam and the control link, a second connecting link connecting the input cam and the driving cam, and a valve opening unit configured to contact the contact portion of the driving cam such that the valve opening unit is opened or closed in accordance with pivoting of the driving cam, wherein a valve lift of the valve opening unit is variable according to the rotation angle of the control shaft.

The contact portion may include a zero lift portion wherein a contour thereof is constant from a center of the control shaft, and a lift portion wherein a contour thereof is gradually thicker away from the center of the control shaft.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
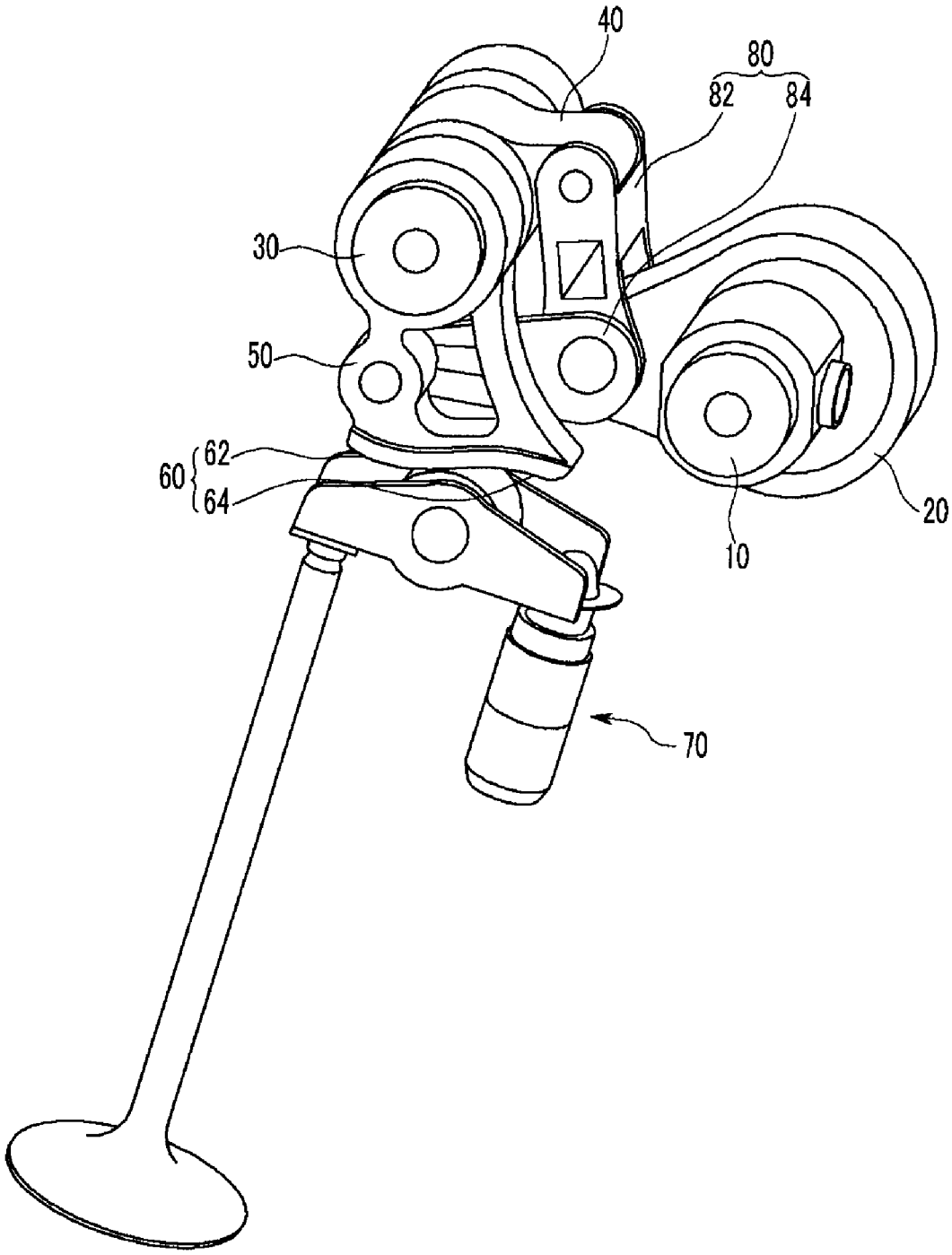
FIG. 1 is a perspective view of a variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

FIG. 1 is a perspective view of a variable valve lift apparatus according to an exemplary embodiment of the present invention.

Referring to FIG. 1, a variable valve lift apparatus according to an exemplary embodiment of the present invention includes input unit, a control link 40 disposed to a control shaft 30.

The input unit includes a camshaft 10 and an input cam 20 eccentrically disposed to the camshaft 10, and the control shaft 30 is parallel with the camshaft 10.

A driving cam 50 is pivotally disposed to the control shaft 30, a contact portion 60 is formed to the driving cam 50 and a valve opening unit 70 is disposed for contacting the contact portion 60 to be opened and closed in accordance with pivoting of the driving cam 50.

The control link 40, the input cam 20 and the driving cam 50 are connected by a connecting unit 80 and contact positions of the valve opening unit 70 and the contact portion 60 are variable according to a relative rotation angle of the control link 40 around the control shaft 30.

The connecting unit 80 includes a first connecting link 82 connecting the input cam 20 and the control link 40 and a second connecting link 84 connecting the input cam 20 and the driving cam 50.

The contact portion 60 includes a zero lift portion 62 and a lift portion 64 and wherein a cross-section of the zero lift portion 62 is constant (R) from a center of the control shaft 30 and a cross-section of the lift portion 64 is gradually thicker away from the center of the control shaft 30.

The relative rotation angle of the control link 40 around the control shaft 30 can be variable according to an engine operation condition and the relative rotation angle of the control link 40 can be controlled by an actuator, a step motor and so on. The control of the relative rotation angle of the control link 40 around the control shaft 30 can be achieved by a person skilled in the art so that detailed explanation will be omitted.

Figure 2:
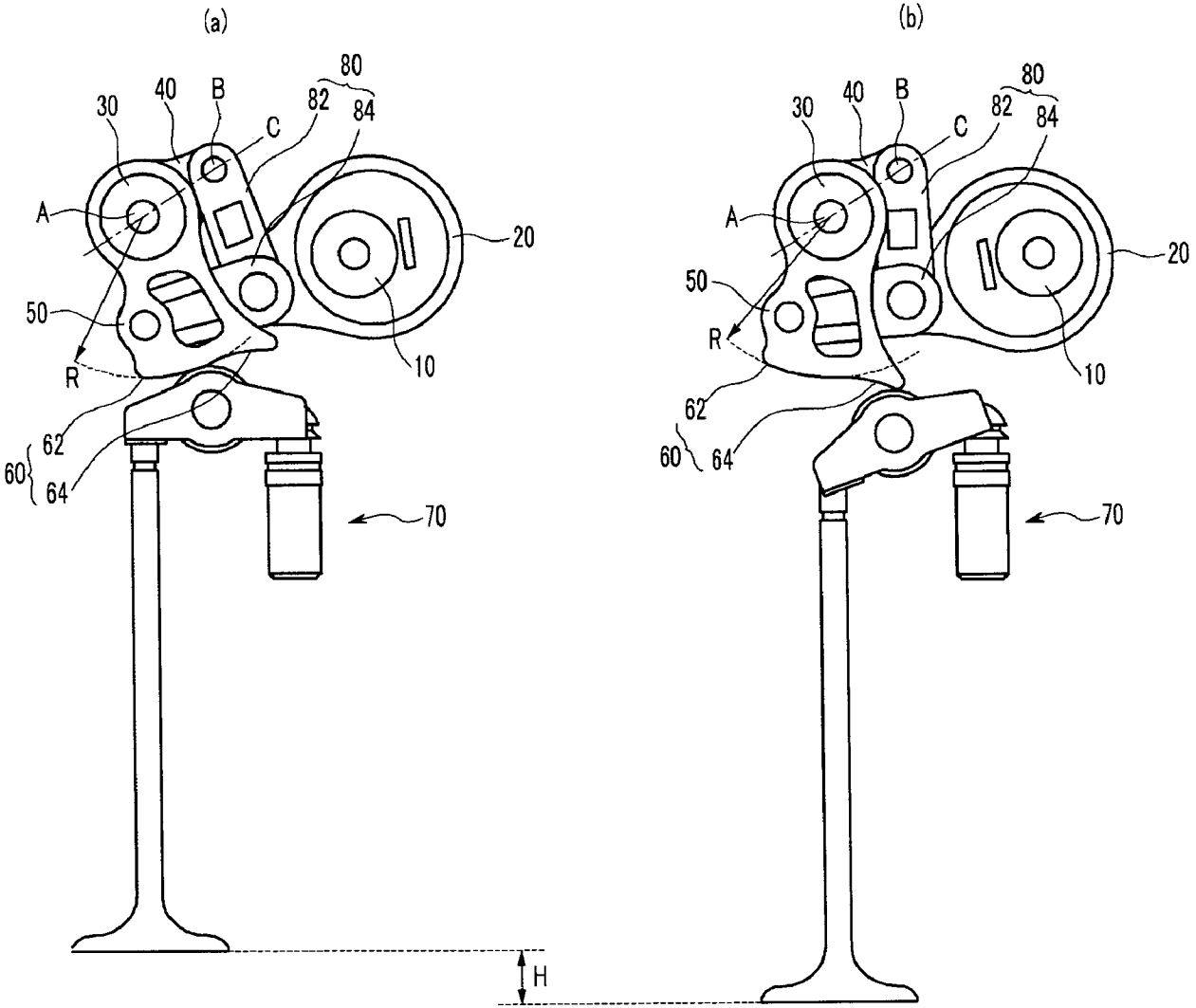
FIG. 2 is a drawing showing operation in high lift mode of a continuously variable valve lift apparatus according to an exemplary embodiment of the present invention.
Figure 3:
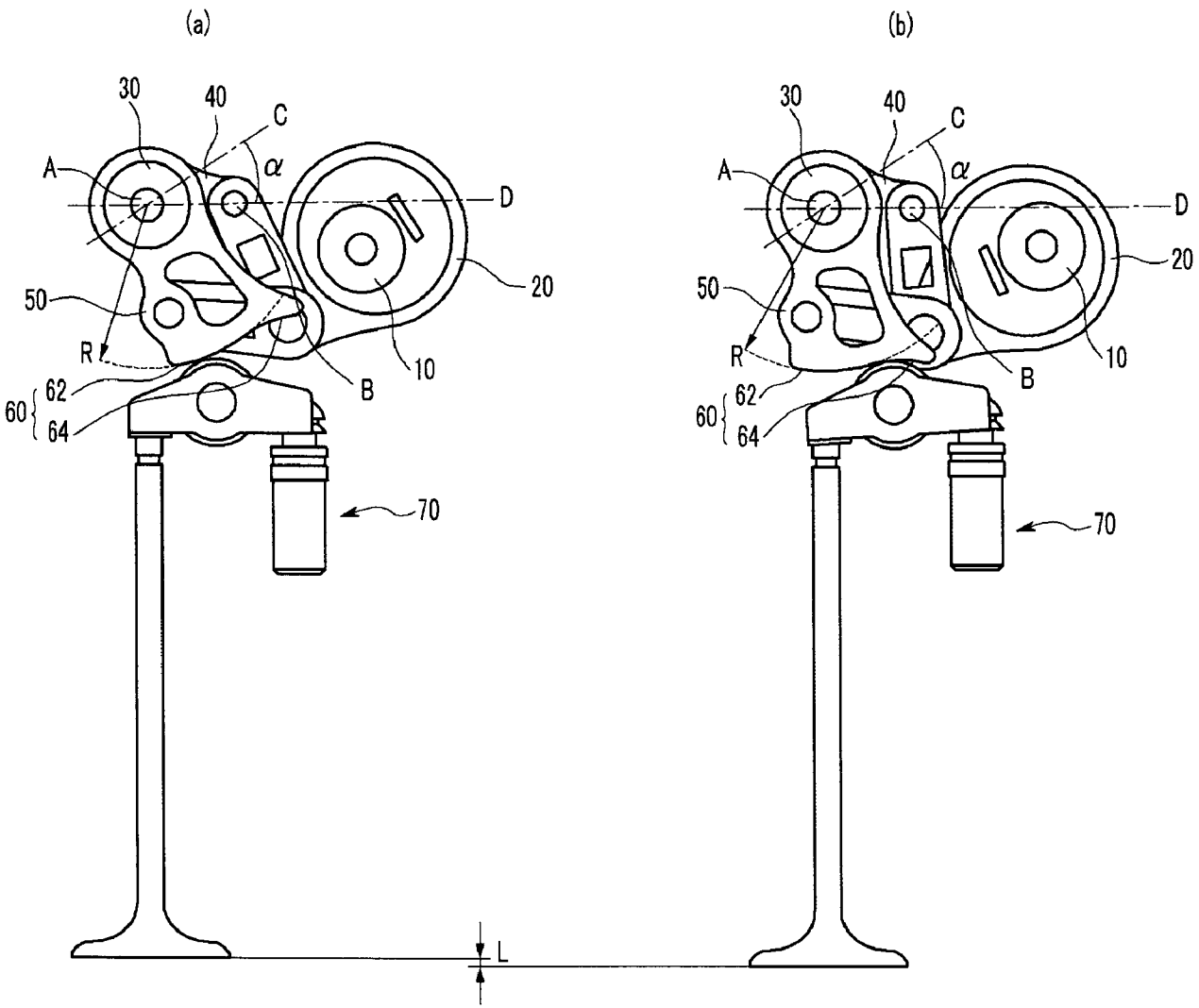
FIG. 3 is a drawing showing operation in low lift mode of a continuously variable valve lift apparatus according to an exemplary embodiment of the present invention.

(a) and (b) of FIG. 2 are respectively showing a valve closed state and a opened state in the high lift mode and (a) and (b) of FIG. 3 are respectively showing a valve closed state and a opened state in the low lift mode.

Hereinafter, referring to FIG. 2 and FIG. 3, operations of the variable valve lift apparatus according to an exemplary embodiment of the present invention will be explained.

"A" in the drawing indicates a center of the control shaft 30 and "B" indicates a connecting portion of the control link 40 and the first connecting link 82.

"C" is an imaginary line connecting the "A" and the "B" in the high lift mode and "D" is an imaginary line connecting the "A" and the "B" in the low lift mode.

The cross-section of the zero lift portion 62 is constant (R) from the "A" and the cross-section of the lift portion 64 is gradually thicker away from the "A".

The relative rotation angle of the control link 40 around the control shaft 30 is relatively positioned in anticlockwise direction in the drawings.

When the camshaft 10 rotates, the input cam 20, which is eccentrically disposed to the camshaft 10, rotates, the connecting unit 80 reciprocates and the driving cam 50 connected with the connecting unit 80 pivots around the control shaft 30.

Then the zero lift portion 62 and the lift portion 64 repeatedly contacts the valve opening unit 70 by pivoting of the driving cam 50 and the valve opening unit 70 is closed and opened.

The variable valve lift apparatus is changed to the low lift mode when vehicle drives in low performance of an engine.

In the low lift mode, the control shaft 30 is turned to clockwise direction.

That is, the control link 40 is turned as "$\alpha$" as shown in FIG. 3.

Then, relative distance between the driving cam 50 and the input cam 20 become close, an interval that the zero lift portion 62 contacts the valve opening unit 70 is relatively elongated and an interval that the lift portion 64 contacts the valve opening unit 70 is relatively shortened.

The cross-section of the zero lift portion 62 is constant (R) from the "A" so that valve is not opened. Thus valve lift (L) of the continuous variable valve lift apparatus is relative shorter comparing to that in the high lift mode (H).

In the exemplary embodiment of the present invention, the high lift mode and low lift mode are explained; however, the valve lift can be modulated continuously by controlling the relative rotation angle of the control link 40 around the control shaft 30.

If the relative rotation angle of the control link 40 around the control shaft 30 is modulated or design of the zero lift portion 62 and the lift portion 64 is changed, CDA (cylinder deactivation) can be achieved.

That is, if the control link 40 is turned to clockwise direction in the FIG. 3, the lift portion 64 does not contact the valve opening unit 70 so that valve is not opened.

The operation of the continuous variable valve lift apparatus according to the exemplary embodiment of the present invention can be explained another way.

That is, relative pivoting angle change of the driving cam 50 around the control shaft 30 is proportionally changed according to the relative angle change ($\alpha$) of the control link 40.

Figure 4:
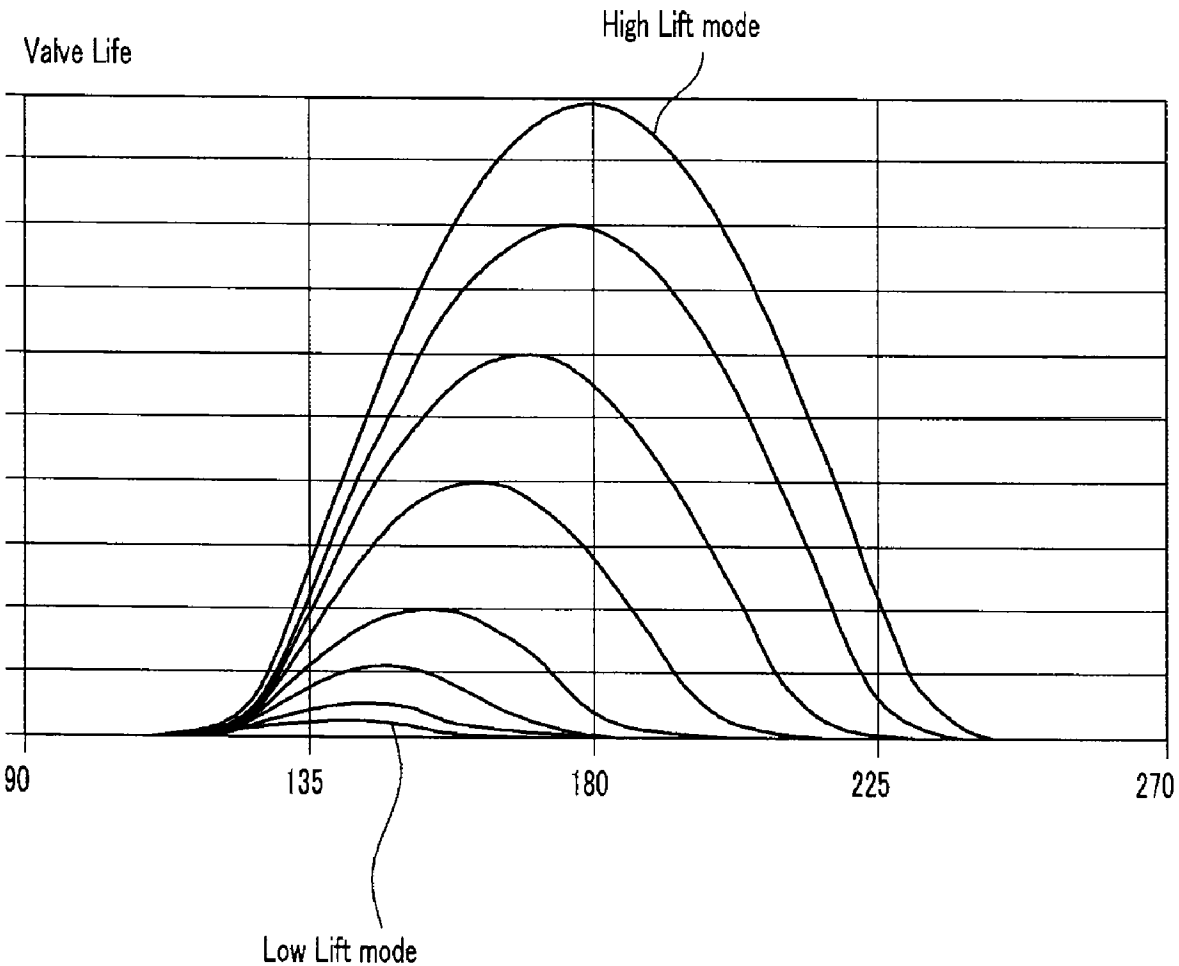
FIG. 4 is a drawing showing valve lift profile of a continuously variable valve lift apparatus according to an exemplary embodiment of the present invention.

FIG. 4 is a drawing showing valve lift profile of a continuously variable valve lift apparatus according to an exemplary embodiment of the present invention.

As shown in FIG. 4, if rotating direction of the camshaft 10 is opposite to rotating direction of the control link 40 from the high lift mode to the low lift mode, the valve lift is advanced.

Thus, engine performance can be improved in the low load driving condition.

For convenience in explanation and accurate definition in the appended claims, the terms "lower" and "upper" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve lift apparatus comprising:

an input unit including a cam shaft and an input cam eccentrically disposed to the camshaft;

a control link fastened to a control shaft;

a driving cam including a contact portion, wherein the driving cam pivots with the control shaft;

a valve opening unit that contacts the contact portion and is opened and closed in accordance with pivoting of the driving cam, wherein the control link, the input unit and the driving cam are connected by a connecting unit including a first connecting link connecting the input cam and the control link, and a second connecting link connecting the input cam and the driving cam, and wherein contact positions of the valve opening unit with the contact portion are variable according to a relative rotation angle of the control link around the control shaft.

2. The continuous variable valve lift apparatus of claim 1, wherein the contact portion comprises:

a zero lift portion wherein a contour thereof is constant from a center of the control shaft; and a lift portion wherein a contour thereof is gradually thicker away from the center of the control shaft.

3. A continuous variable valve lift apparatus comprising:

a camshaft;

an input cam eccentrically coupled to the camshaft;

a control shaft parallel with the camshaft;

a driving cam pivoting with the control shaft; and a valve opening unit that is opened and closed in accordance with pivoting of the driving cam;

a control link fastened to the control shaft; and a connecting unit connecting the control link, the input cam and the driving cam, the connecting unit including a first connecting link connecting the input cam and the control link, and a second connecting link connecting the input cam and the driving cam, wherein a valve lift is variable according to a relative pivoting angle of the driving cam around the control shaft.

4. The continuous variable valve lift apparatus of claim 3, further comprises a contact portion formed to the driving cam, wherein the valve opening unit contacts the contact portion.

5. The continuous variable valve lift apparatus of claim 4, wherein the contact portion comprises:

a zero lift portion wherein a contour thereof is constant from a center of the control shaft; and a lift portion wherein a contour thereof is gradually thicker away from the center of the control shaft.

6. A continuous variable valve lift apparatus comprising:

a camshaft;

an input cam eccentrically coupled to the camshaft;

a control shaft coupled to an actuator to control a rotation angle of the control shaft;

a control link fastened to the control shaft;

a driving cam pivoting with the control shaft and including a contact portion, a first connecting link connecting the input cam and the control link;

a second connecting link connecting the input cam and the driving cam; and a valve opening unit configured to contact the contact portion of the driving cam such that the valve opening unit is opened or closed in accordance with pivoting of the driving cam, wherein a valve lift of the valve opening unit is variable according to the rotation angle of the control shaft.

7. The continuous variable valve lift apparatus of claim 6, wherein the contact portion comprises:

a zero lift portion wherein a contour thereof is constant from a center of the control shaft; and a lift portion wherein a contour thereof is gradually thicker away from the center of the control shaft.

* * * * *